US007118658B2

(12) United States Patent
Woodruff et al.

(10) Patent No.: US 7,118,658 B2
(45) Date of Patent: Oct. 10, 2006

(54) ELECTROPLATING REACTOR

(75) Inventors: Daniel J. Woodruff, Kalispell, MT (US); Kyle M. Hanson, Kalispell, MT (US)

(73) Assignee: Semitool, Inc., Kalispell, MT (US)

( * ) Notice: Subject to any disclaimer, the term of this patent is extended or adjusted under 35 U.S.C. 154(b) by 479 days.

(21) Appl. No.: 10/154,426

(22) Filed: May 21, 2002

(65) Prior Publication Data

US 2003/0217916 A1 Nov. 27, 2003

(51) Int. Cl.
*C25C 7/00* (2006.01)
*C25D 17/00* (2006.01)

(52) U.S. Cl. ..... 204/242; 204/224 R; 204/275.1; 204/277; 204/297.01; 204/288.3; 204/286.1; 205/291

(58) Field of Classification Search ..... 204/224 R, 204/279, 297.14, 288.3, 277, 242, 297.01, 204/212, 275.1, 286.1; 205/148, 291
See application file for complete search history.

(56) References Cited

U.S. PATENT DOCUMENTS 3,798,003 A 3/1974 Ensley et al.
4,113,577 A 9/1978 Ross et al.
4,137,867 A 2/1979 Aigo
4,165,252 A 8/1979 Gibbs
4,222,834 A 9/1980 Bacon et al.
4,246,088 A 1/1981 Murphy et al.
4,259,166 A 3/1981 Whitehurst
4,304,641 A 12/1981 Grandai et al.
4,339,319 A * 7/1982 Aigo ..... 204/224 R
4,341,629 A 7/1982 Uhlinger
4,360,410 A 11/1982 Fletcher et al.
4,422,915 A 12/1983 Wielonski et al.
4,466,864 A 8/1984 Bacon et al.
4,469,566 A 9/1984 Wray
4,576,685 A 3/1986 Goffredo et al.
4,585,539 A 4/1986 Edson
4,685,414 A 8/1987 DiRico
4,696,729 A 9/1987 Santini
4,715,934 A 12/1987 Tamminen
4,741,624 A 5/1988 Barroyer
4,868,992 A 9/1989 Crafts et al.
4,913,085 A 4/1990 Vohringer et al.
5,024,746 A 6/1991 Stierman et al.
5,135,636 A 8/1992 Yee et al.

(Continued)

FOREIGN PATENT DOCUMENTS

DE 4411427 11/1992

(Continued)

OTHER PUBLICATIONS

Buehler Simplement 2000-FN00682 and FN00935.

(Continued)

*Primary Examiner*—Roy King
*Assistant Examiner*—Lois Zheng
(74) *Attorney, Agent, or Firm*—Perkins Coie LLP

(57) ABSTRACT

A reactor for electroplating a workpiece includes a vessel having a ring contact arranged to support a workpiece in a horizontal orientation. In an embodiment of the invention, an electrode is arranged below the ring contact, and a pressing member is arranged above the ring contact to press a workpiece into electrical engagement with the ring contact. The vessel may be adapted to contain an electroplating fluid between a top of the ring contact and the electrode. In one embodiment, a movable intermediate workpiece support assembly is carried by the vessel, the support assembly being actuatable to lower a workpiece carried thereby to deliver the workpiece to be supported accurately and precisely on the ring contact.

23 Claims, 14 Drawing Sheets

U.S. PATENT DOCUMENTS 5,139,818 A 8/1992 Mance
5,169,408 A 12/1992 Biggerstaff et al.
5,227,041 A * 7/1993 Brogden et al. ..... 204/297.05
5,271,953 A 12/1993 Litteral
5,271,972 A 12/1993 Kwok et al.
5,310,580 A 5/1994 O'Sullivan et al.
5,332,271 A 7/1994 Grant et al.
5,340,456 A 8/1994 Mehler
5,344,491 A 9/1994 Katou
5,389,496 A 2/1995 Calvert et al.
5,391,285 A 2/1995 Lytle et al.
5,405,518 A 4/1995 Hsieh et al.
5,427,674 A 6/1995 Langenskiold et al.
5,441,629 A 8/1995 Kosaki
5,443,707 A 8/1995 Mori
5,447,615 A * 9/1995 Ishida ..... 204/224 R
5,514,258 A 5/1996 Brinket et al.
5,522,975 A 6/1996 Andricacos et al.
5,550,315 A 8/1996 Stormont
5,597,460 A 1/1997 Reynolds
5,597,836 A 1/1997 Hackler et al.
5,609,239 A 3/1997 Schlecker
5,670,034 A 9/1997 Lowery
5,683,564 A 11/1997 Reynolds
5,684,654 A 11/1997 Searle et al.
5,731,678 A 3/1998 Zila et al.
5,744,019 A 4/1998 Ang
5,747,098 A 5/1998 Larson
5,755,948 A 5/1998 Lazaro et al.
5,776,327 A 7/1998 Botts et al.
5,788,829 A 8/1998 Joshi et al.
5,829,791 A 11/1998 Kotsubo et al.
5,843,296 A 12/1998 Greenspan
5,904,827 A 5/1999 Reynolds
5,909,123 A 6/1999 Budnaitis
5,932,077 A 8/1999 Reynolds
5,935,330 A * 8/1999 Taniguchi ..... 118/66
5,980,706 A 11/1999 Bleck et al.
5,985,126 A 11/1999 Bleck
6,001,235 A 12/1999 Arken et al.
6,027,631 A 2/2000 Broadbent
6,080,288 A 6/2000 Schwartz et al.
6,080,291 A 6/2000 Woodruff
6,099,702 A 8/2000 Reid et al.
6,103,085 A 8/2000 Woo et al.
6,139,712 A 10/2000 Patton et al.
6,143,147 A 11/2000 Jelinek
6,156,167 A 12/2000 Patton et al.
6,159,354 A 12/2000 Contolini et al.
6,193,859 B1 2/2001 Contolini et al.
6,228,231 B1 5/2001 Uzoh
6,228,232 B1 5/2001 Woodruff
6,228,233 B1 * 5/2001 Lakshmikanthan et al. . 204/277
6,251,236 B1 6/2001 Stevens
6,254,742 B1 7/2001 Hanson et al.
6,258,223 B1 7/2001 Cheung et al.
6,267,853 B1 7/2001 Dordi et al.
6,274,013 B1 8/2001 Bleck et al.
6,280,582 B1 8/2001 Woodruff et al.
6,280,583 B1 8/2001 Woodruff et al.
6,303,010 B1 10/2001 Woodruff et al.
6,309,520 B1 10/2001 Woodruff et al.
6,309,524 B1 10/2001 Woodruff
6,326,587 B1 12/2001 Cardineau
6,334,937 B1 1/2002 Batz
6,409,892 B1 6/2002 Woodruff et al.
6,428,660 B1 8/2002 Woodruff et al.
6,428,662 B1 8/2002 Woodruff et al.
6,527,925 B1 * 3/2003 Batz et al. ..... 204/297.01
6,645,356 B1 11/2003 Woodruff et al.
6,669,510 B1 12/2003 Yamawaki et al.
6,699,373 B1 3/2004 Woodruff et al.
2001/0000396 A1 * 4/2001 Dordi et al. ..... 204/212
2003/0047448 A1 3/2003 Woodruff et al.
2003/0141185 A1 7/2003 Wilson et al.
2003/0173209 A1 9/2003 Batz et al.
2003/0196892 A1 10/2003 Batz et al.
2004/0035694 A1 2/2004 Batz et al.

FOREIGN PATENT DOCUMENTS

JP 9-2628886 4/1997
JP 2002-520489 7/2002
TW 573070 1/2004
WO WO-00/03067 7/1998
WO WO-99/25904 5/1999
WO WO-99/25905 5/1999
WO WO-00/03072 1/2000
WO WO-00/32835 6/2000
WO WO-00/40779 7/2000

OTHER PUBLICATIONS

Parker (Editor), "McGraw-Hill Dictionary of Scientific and Technical Terms, Fifth Edition," McGraw-Hill, Inc., 1994, definition of "bayonet coupling".

* cited by examiner

ELECTROPLATING REACTOR

BACKGROUND

In the production of semiconductor integrated circuits and other semiconductor articles from semiconductor wafers, it is often necessary to provide multiple metal layers on the wafer to serve as interconnect metallization which electrically connect the various devices on the integrated circuit to one another. Traditionally, aluminum has been used for such interconnects, however, it is now recognized that copper metallization may be preferable.

The semiconductor manufacturing industry has applied copper onto semiconductor wafers by using a "damascene" electroplating process where holes, commonly called "vias", trenches or other recesses are formed onto a substrate and into which copper is filled. In the damascene process, the wafer is first provided with a metallic seed layer which is used to conduct electrical current during a subsequent metal electroplating step. The seed layer is a very thin layer of metal which can be applied using one or more of several processes. For example, the seed layer of metal can be laid down using physical vapor deposition or chemical vapor deposition processes to produce a layer on the order of 1,000 angstroms thick. The seed layer can advantageously be formed of copper, gold, nickel, palladium, or other metals. The seed layer is formed over a surface which is convoluted by the presence of the vias, trenches, or other recessed device features.

A copper layer is then electroplated onto the seed layer in the form of a blanket layer. The blanket layer is plated to an extent which forms an overlying layer, with the goal of providing a copper layer that fills the trenches and vias and extends a certain amount above these features. Such a blanket layer will typically be formed in thicknesses on the order of 10,000 to 15,000 angstroms (1–1.5 microns).

After the blanket layer has been electroplated onto the semiconductor wafer, excess metal material present outside of the vias, trenches, or other recesses is removed. The metal is removed to provide a resulting pattern of metal layer in the semiconductor integrated circuit being formed. The excess plated material can be removed, for example, using chemical mechanical planarization. Chemical mechanical planarization is a processing step which uses the combined action of a chemical removal agent and an abrasive which grinds and polishes the exposed metal surface to remove undesired parts of the metal layer applied in the electroplating step.

The electroplating of semiconductor wafers takes place in a reactor assembly. In such an assembly, an anode electrode is disposed in a plating bath, and the wafer with the seed layer thereon is used as a cathode. Commonly, only a lower face of the wafer contacts the surface of the plating bath. The wafer is held by a support system that also conducts the requisite cathode current to the wafer. The support system may comprise conductive fingers that secure the wafer in place and also contact the wafer in order to conduct electrical current for the plating operation.

One embodiment of a reactor assembly is disclosed in U.S. Pat. No. 5,985,126, entitled "Semiconductor Plating System Workpiece Support Having Workpiece-Engaging Electrodes With Distal Contact Part And Dielectric Cover," which is herein incorporated by reference.

FIG. 1 illustrates such a reactor assembly 10 for electroplating a metal, such as copper, onto a semiconductor wafer. The assembly 10 includes a reactor vessel 11 and a processing or reactor head 12. The vessel includes an electroplating bowl assembly 14.

As shown in FIG. 1, the electroplating bowl assembly 14 includes a cup assembly 16 which is disposed within a reservoir chamber 18. Cup assembly 16 includes a fluid cup 20 holding the electroplating fluid for the electroplating process. The cup assembly of the illustrated embodiment also has a depending skirt 26 which extends below a cup bottom 30 and may have flutes open therethrough for fluid communication and release of any gas that might collect as the reservoir chamber fills with liquid. The cup can be made from polypropylene or other suitable material.

A bottom opening in the bottom wall 30 of the cup assembly 16 receives a polypropylene riser tube 34 which is adjustable in height relative thereto by a threaded connection between the bottom wall 30 and the tube 34. A fluid delivery tube 44 is disposed within the riser tube 34. A first end of the delivery tube 44 is secured by a threaded connection 45 to the rear portion of an anode shield 40 which carries an anode 42. The delivery tube 44 supports the anode within the cup. The fluid delivery tube 44 is secured to the riser tube 34 by a fitting 50. The fitting 50 can accommodate height adjustment of the delivery tube 44 within the riser tube. As such, the connection between the fitting 50 and the riser tube 34 facilitates vertical adjustment of the delivery tube and thus the anode vertical position. The delivery tube 44 can be made from a conductive material, such as titanium, and is used to conduct electrical current to the anode 42 as well as to supply electroplating fluid to the cup.

Electroplating fluid is provided to the cup through the delivery tube 44 and proceeds therefrom through fluid outlet openings 56. Electroplating fluid fills the cup through the openings 56, supplied from a electroplating fluid pump (not shown).

An upper edge of the cup side wall 60 forms a weir which limits the level of electroplating fluid or process fluid within the cup. This level is chosen so that only the bottom surface of the wafer W is contacted by the electroplating fluid. Excess fluid pours over this top edge into the reservoir chamber 18. The level of fluid in the chamber 18 can be maintained within a desired range for stability of operation by monitoring and controlling the fluid level with sensors and actuators. One configuration includes sensing a high level condition using an appropriate switch 63 and then draining fluid through a drain line controlled by a control valve (not shown). The out flow fluid from chamber 18 can be returned to a suitable reservoir. The fluid can then be treated with additional plating chemicals or other constituents of the plating or other process liquid, and used again.

A diffusion plate 66 is provided above the anode 42 for providing a more even distribution of the fluid plating bath across the surface of wafer W. Fluid passages in the form of perforations are provided over all, or a portion of, the diffusion plate 66 to allow fluid communication therethrough. The height of the diffusion plate within the cup assembly is adjustable using threaded diffusion plate height adjustment mechanisms 70.

The anode shield 40 is secured to the underside of the consumable anode 42 using anode shield fasteners 74. The anode shield prevents direct impingement on the anode by the plating solution as the solution passes into the processing chamber. The anode shield 40 and anode shield fasteners 74 can be made from a dielectric material, such as polyvinylidene fluoride or polypropylene. The anode shield serves to electrically isolate and physically protect the backside or the anode. It also reduces the consumption of organic plating fluid additives.

The processing head 12 holds a wafer W for rotation about a vertical axis R within the processing chamber. The processing head 12 includes a rotor assembly having a plurality of wafer-engaging fingers 89 that hold the wafer against holding features of the rotor. Fingers 89 are preferably adapted to conduct current between the wafer and a plating electrical power supply and act as current thieves. Portions of the processing head 12 may mate with the processing bowl assembly 14 to provide a substantially closed processing volume 13.

The processing head 12 can be supported by a head operator. The head operator can include an upper portion which is adjustable in elevation to allow height adjustment of the processing head. The head operator also can have a head connection shaft which is operable to pivot the head 12 about a horizontal pivot axis. Pivotal action of the processing head using the operator allows the processing head to be placed in an open or face-up position (not shown) for loading and unloading wafer W with a surface-to-be-processed in a face-up orientation.

Processing exhaust gas may be removed from the volume 13 through an exhaust system. FIG. 1 illustrates an outer vessel side wall 76 which extends upwardly from the vessel base plate 75 to a top end into which is nested an intermediate exhaust ring 77 having circumferentially spaced-apart slots 78 therethrough. The slots 78 communicate exhaust gas from inside the vessel 13 to a thin annular plenum 79 located between the intermediate exhaust ring 77 and the outer bowl side wall 76. Surrounding the outer bowl side wall 76 is a vessel ring assembly 80 which forms with the side wall 76 an external, annular collection chamber 81. Gas which is collected in the plenum 79 passes through intermittent orifices 82 and into the annular collection chamber 81. Gas collected in the collection chamber 81 is passed through an exhaust nozzle 83 to be collected and recycled.

The reactor assembly 10 of FIG. 1 can be used reliably in electroplating semiconductor wafers. However, the reactor head 12 is relatively expensive to manufacture. The reactor head 12 is adapted to move vertically, to rotate about a horizontal axis to facilitate loading and unloading wafers W, and to rotate about a vertical axis R to spin the wafer W during plating. Delivering electroplating power from an external power supply (not shown) to the fingers 89 of the reactor head 12 requires relatively complex, expensive electrical connections such as slip ring contacts. If the wafer W could be held stationary with respect to the electroplating bowl assembly 14, the reactor head 12 could be simplified by eliminating the motor used to rotate the wafer W about the axis R. The series of spaced-apart fingers 89 deliver adequate electroplating power to the wafer W. The relatively small contact area between the fingers 89 and the wafer can lead to localized variations in the electroplating power across the surface of the wafer, though, making it more difficulty to ensure good plating uniformity.

SUMMARY

One embodiment of the present invention contemplates an electroplating reactor for electroplating workpieces or substrates having a workpiece holder which holds the workpiece, such as a wafer, with a plating side facing downwardly toward an electrode. The workpiece may be electrically coupled to a ring contact, e.g., by electrically contacting an outside region of the workpiece with the electrode. In certain applications, the workpiece holder can be non-rotating. The electrode may be submerged in an electroplating fluid. The reactor can include an improved support arrangement for supporting a diffusion plate above the electrode to improve distribution of the fluid plating bath on the workpiece surface.

In another embodiment, the invention contemplates a ring contact which provides a substantially continuous contact surface around the entirety of an exclusion zone, which may include the annular outer edge of the workpiece. The ring contact can be serrated or otherwise have radial passages therethrough to allow flow through the ring contact for flow type plating.

An alternative embodiment of the invention contemplates a finger support system for receiving a workpiece and for lowering a workpiece from a reactor head onto a movable intermediate support system mounted to the reactor vessel. The finger support system is pivotable to clear or move away from the workpiece after the workpiece is placed onto the movable intermediate support system. The movable intermediate support system includes supports that lower and accurately and precisely place the workpiece onto the contact surface of the ring contact. The supports of the movable intermediate support system may be slidable and/or pivotable to clear or move away from the workpiece after the workpiece is placed onto the ring contact.

Numerous other advantages and features of the present invention will become readily apparent from the following detailed description of the invention and the embodiments thereof, from the claims, and from the accompanying drawings in which details of the invention are fully and completely disclosed as part of this specification.

DETAILED DESCRIPTION

Figure 1:
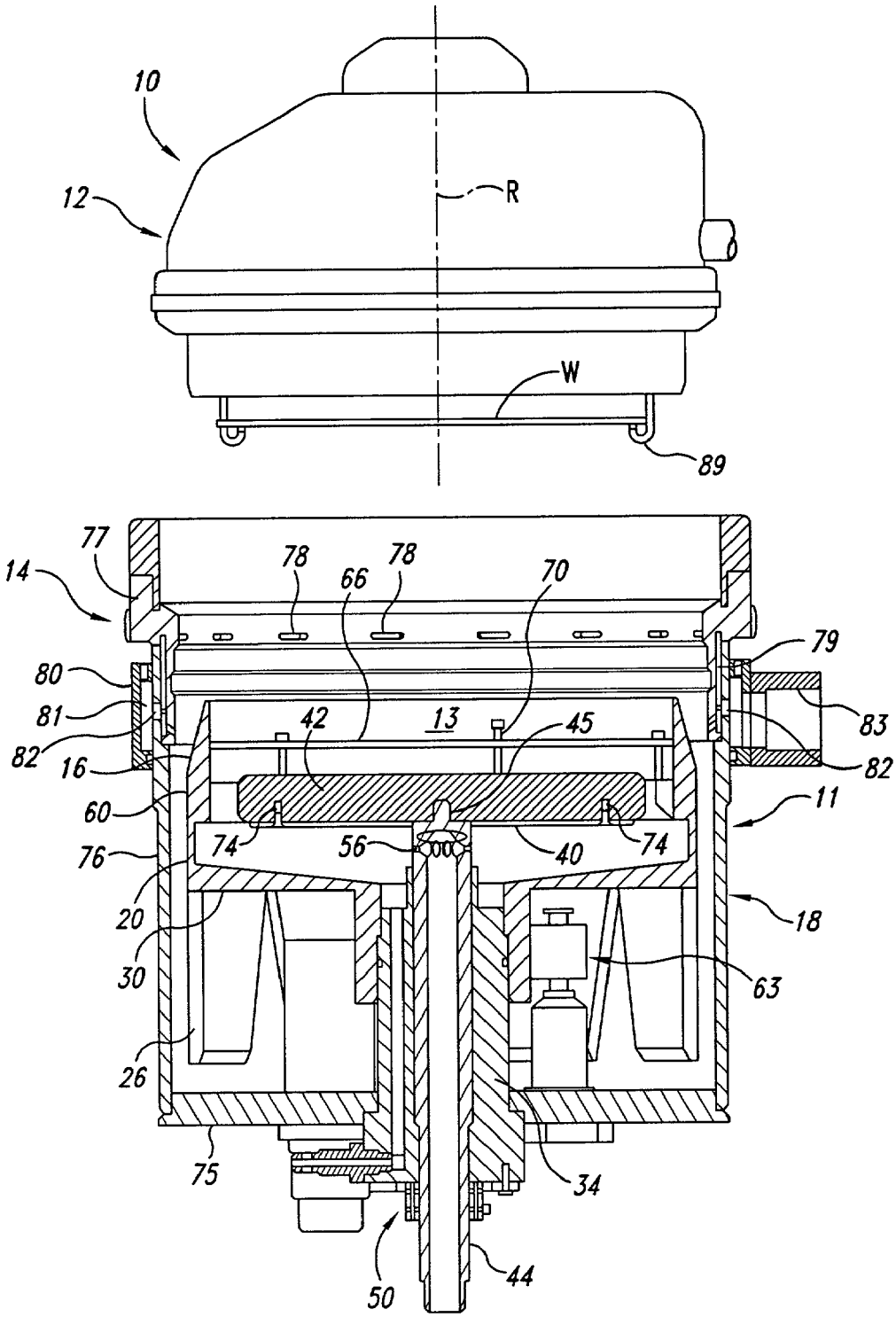
Fig. 1 (Prior Art)
FIG. 1 is a sectional view of an electroplating apparatus wherein a workpiece plated thereby is rotatively held by the reactor head.

While this invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

Figure 2:
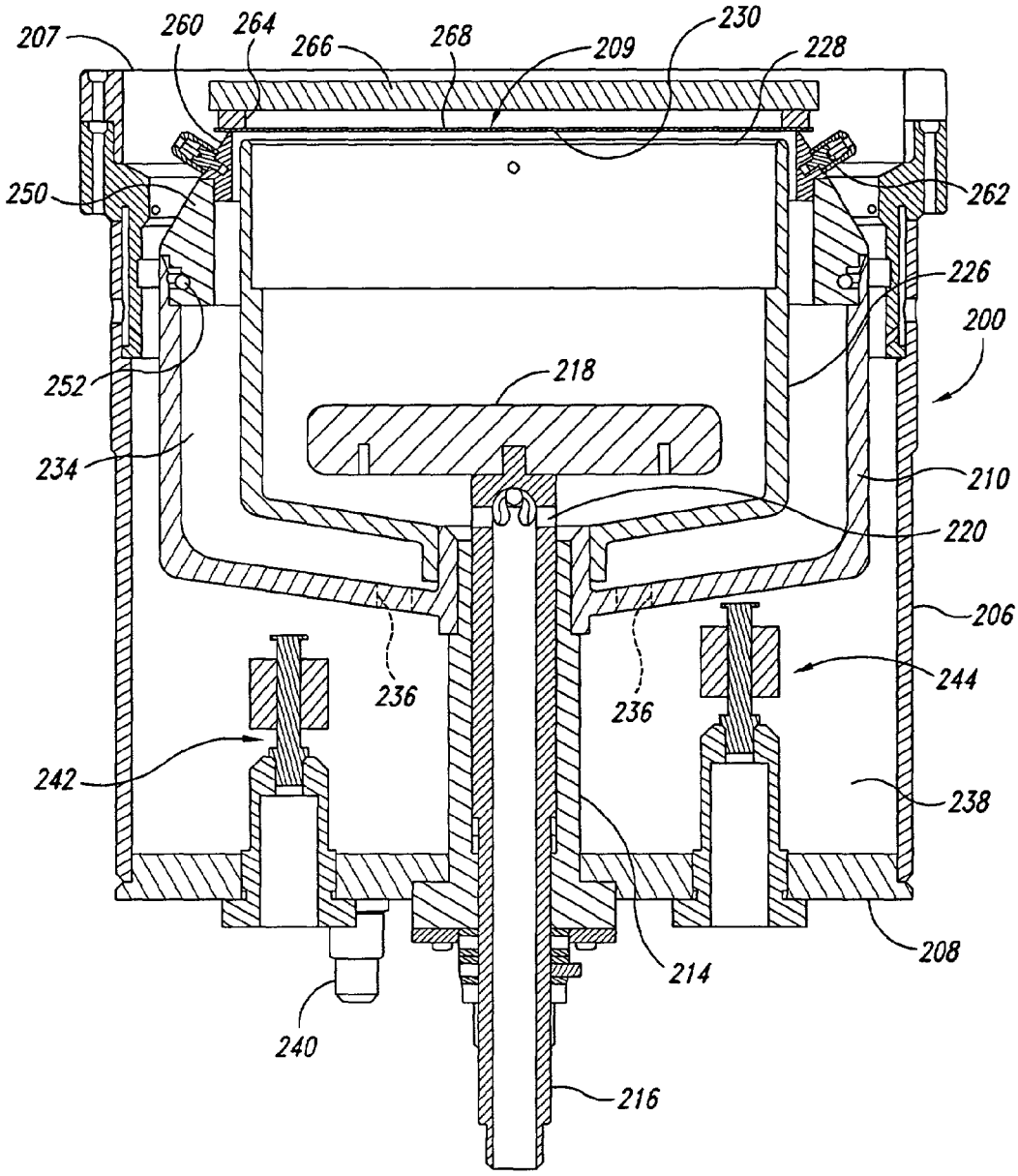
FIG. 2 is a simplified, sectional view of a reactor vessel according to one embodiment of the invention.
Figure 3:
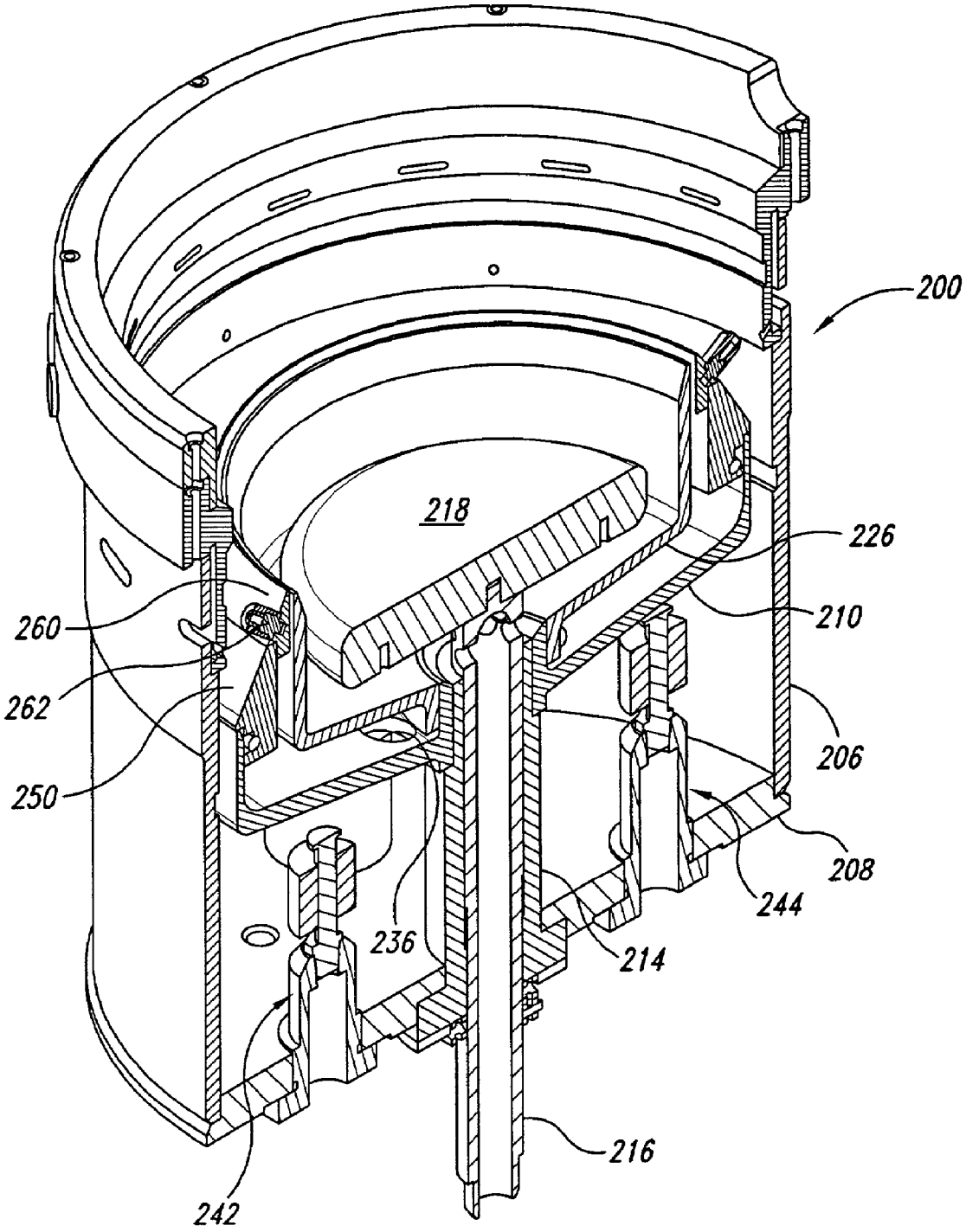
FIG. 3 is a simplified perspective sectional view of the reactor vessel of FIG. 2.
Figure 4:
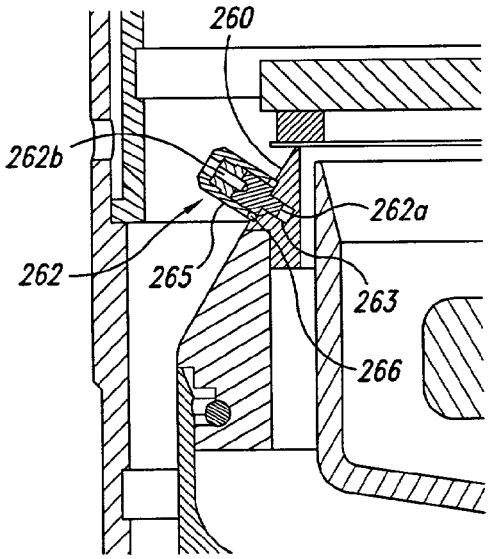
FIG. 4 is a simplified, enlarged sectional view of a portion of FIG. 2.

FIGS. 2–4 illustrate a reactor vessel 200 having a surrounding vessel side wall 206 and a vessel base 208 sealed thereto. If so desired, a movable reactor head (not shown in FIGS. 2–4) may be placed over a top 207 of the vessel to close the vessel. A workpiece or substrate 209 is processed within the vessel 200. A "substrate" is a base layer of material over which one or more metallization levels are disposed. A substrate may be, for example, a semiconductor wafer, a ceramic block, etc. A "workpiece" is an object that at least comprises a substrate, and may include further layers of material or manufactured components, such as one or more metallization levels, disposed on the substrate.

Within the side wall 206 is an outer cup 210 supported on a cup support post 214. An electrode conductor 216 is located within the support post 214 and supports the electrode 218. (The electrode 218, as discussed below, may have an electrical potential with respect to a surface of a workpiece 209 during plating. The electrode may have a positive charge or a negative charge relative to the workpiece, depending on the nature of the electroplating medium. For sake of convenience, in the following discussion, the electrode 218 is assumed to have a positive potential and it is, consequently, referred to as an anode.) The conductor 216 is electrically conductive and conducts electric current to the anode 218 and delivers electroplating fluid into the vessel 200 through openings 220. An inner cup 226 is situated within the outer cup 210. In one embodiment, the inner cup 226 is vertically adjustable with respect to the outer cup 210. The inner cup 226 includes a top edge 228 which forms a weir for electroplating fluid held within the inner cup 226.

During electroplating, fluid flows over a bottom surface 230 of the workpiece 209, i.e., the surface to be plated. The fluid flows over the edge 228 and into an annular space 234 between the inner and outer cups. The outer cup 210 includes plural holes 236 in a bottom thereof which allow fluid to pass into a reservoir 238 within the reactor 200. Fluid from the reservoir exits via an outlet 240 to be collected, treated and/or recycled or disposed. Level switches 242, 244 maintain the fluid in the reservoir 238 at a desired level by controlling flow out of the outlet 240 via control means such as control valves or pumps (not shown).

An outer cup ring portion 250 may be supported by the outer cup 210, e.g., by mounting the outer cup ring portion 250 to a top of the outer cup 210. The outer cup ring portion 250 may be sealed to the outer cup 210, e.g., via an O-ring 252. A ring contact 260 is carried by the outer cup ring portion 250. The workpiece 209 may be urged into electrical contact with the ring contact 260, e.g., by a resilient backing ring 264 which is carried by a backing plate 266. The backing ring 264 and the backing plate 266 may also act to seal a top surface 268 of the workpiece 209 to prevent exposure of the top surface 268 to the process fluid. The backing ring 264 can be pressed downwardly against the workpiece 209 by a reactor head (not shown in FIGS. 2–4).

The ring contact 260 may include a plurality of ring contact terminals 262, one of which is shown in the enlarged view of FIG. 4. The terminals include a plug 262*a* and a conductor receiving socket 262*b*. The plug 262*a* fits tightly into a plug socket 263 of the ring contact 260. A sealing cover 265 may cover the exposed portions of the terminal 262 and can incorporate an O-ring 266 to seal against the ring contact 260. A conductor (not shown) may have a casing which seals against the cover 265 and has its conducting portion fixed into the socket 262*b*.

Figure 5:
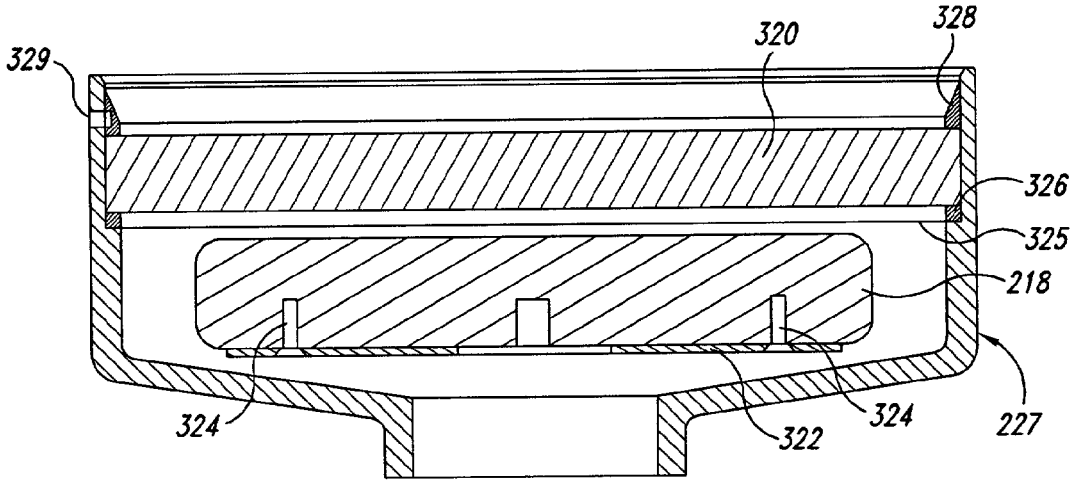
FIG. 5 is a simplified, enlarged partial sectional schematical view of a reactor vessel in accordance with an alternate embodiment of the present invention.

FIG. 5 illustrates schematically an alternate configuration of an inner cup 227 which includes a diffusion plate 320 arranged above the anode 218. Additionally, the anode 218 is carried on an anode shield 322. The anode shield is fastened to the anode by a plurality of screws 324. The anode and the anode shield are supported by the conductor 216 (shown in FIG. 2). The diffusion plate 320 is supported on a ledge 325 of the cup 227 via a support ring 326. The diffusion plate 320 is retained by a hold down ring 328 which is fixed to the cup 227 by a plurality of fasteners 329. The support ring 326 can be a sealing and/or elevation adjustment element. The support ring 326 assists in preventing fluid bypass around the diffusion plate to the wafer surface, i.e., the support ring helps seal between the diffusion plate and the surrounding cup or ring wall to force fluid through the diffusion plate. The diffusion plate supporting arrangement can be incorporated into any of the embodiments described herein. For example, the ledge 325 and the rings 326, 328 as needed, can be incorporated into the cups 16, 226 (FIGS. 1 and 2), or into the cup ring portion 250 or cups 211, 431 (FIGS. 10, 11, 12 and 17).

Figure 6:
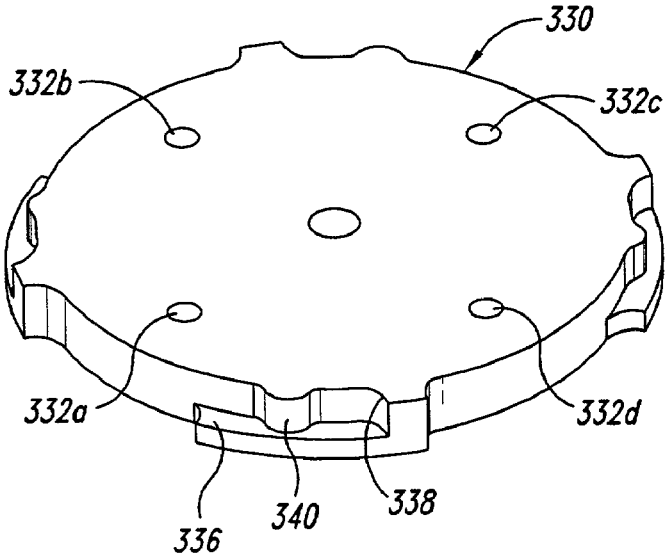
FIG. 6 is a perspective view of an anode shield employed in the reactor vessel of FIG. 5.

FIG. 6 illustrates an alternate anode shield 330 which is fastened to the anode by fasteners via four apertures 332*a*, 332*b*, 332*c*, 332*d*. Additionally, the anode shield 330 includes four engagement formations which comprise four extending plates 336 each formed with an end stop 338 and a rib 340. When the anode is placed over the shield 330 and fastened thereto, each plate 336 forms a slot beneath the anode. A hook (e.g., hook 358 in FIG. 7, discussed below) which enters the slot is forced past the rib 340 to be trapped between the rib 340 and the end stop 338.

Figure 7:
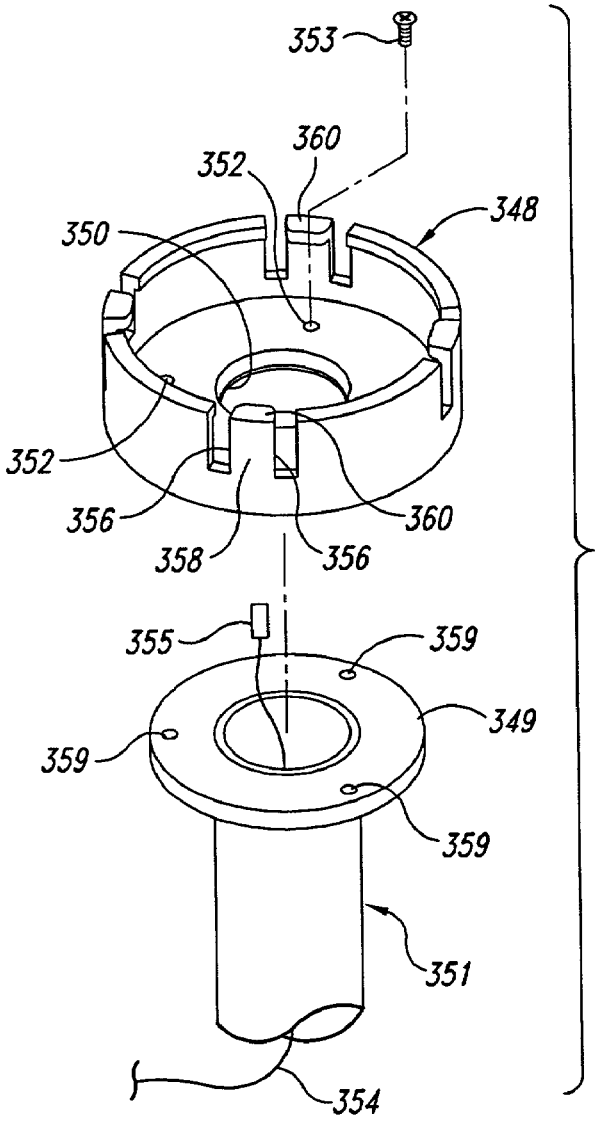
FIG. 7 is an exploded perspective view of a conductor pipe and inlet connector.

FIG. 7 illustrates an inlet connector 348 that includes a central aperture 350 for flow connection to an open flanged end of a conductor pipe 351. Additionally, a separate conductor 354 (shown schematically) can be inserted through the conductor pipe 351 and the aperture 350, and electrically connected to the anode by a plug 355. An exemplary conductor arrangement is described in U.S. Pat. No. 6,228,232, entitled "Reactor Vessel Having Improved Cup, Anode and Conductor Assembly," and herein incorporated by reference.

A plurality of fastener holes 352 are available for receiving screws 353 (only one shown) to attach the connector 348 to a flange 349 of the conductor pipe 351. The flange 349 includes threaded holes 359 for threadedly receiving the screws 353. The connector includes rectangular openings 356 for distributing fluid into the cup.

Between adjacent openings 356, is one of four engagement hooks 358 each having a head or hook portion 360. Each one of the hook portions 360 enters one of the slots formed by the engagement formations of the anode-shield.

The connector 348 may support the anode and anode shield from the conductor pipe 351. By utilizing a bayonet-type arrangement as described, the anode can easily be removed for maintenance by turning and lifting from a top side only of the reactor vessel. This simplifies assembly and reassembly and reduces maintenance costs. Additional benefits of using a bayonet connection to support the anode are described in the aforementioned U.S. Pat. No. 6,228,232.

Figure 8:
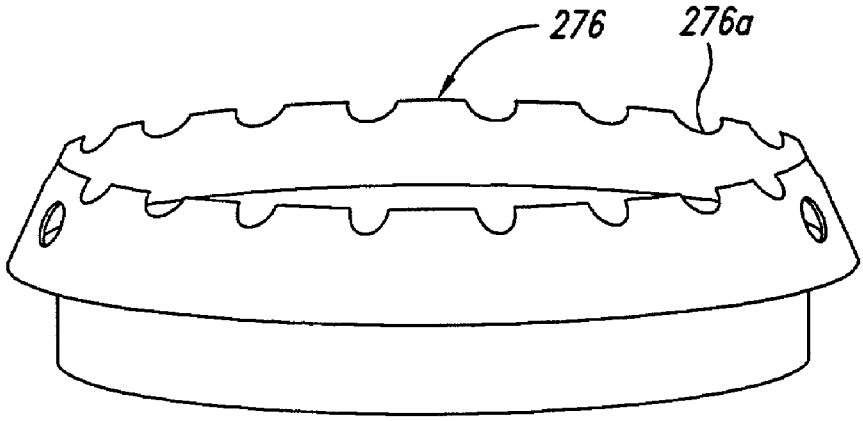
FIG. 8 is a perspective view of an alternate ring contact assembly.

FIG. 8 illustrates an alternate ring contact 276, having a serrated or discontinuous top edge 276*a*. The top edge 276*a* is configured to provide sufficient electrical contact area with a workpiece to deliver sufficient power for plating, yet provide sufficient passages to allow fluid to pass through the ring contact. This type of ring contact may be utilized, for example, in the reactor vessel 200 of FIGS. 2–4 or in the alternative reactor vessels described below with respect to FIGS. 10–12.

Figure 9:
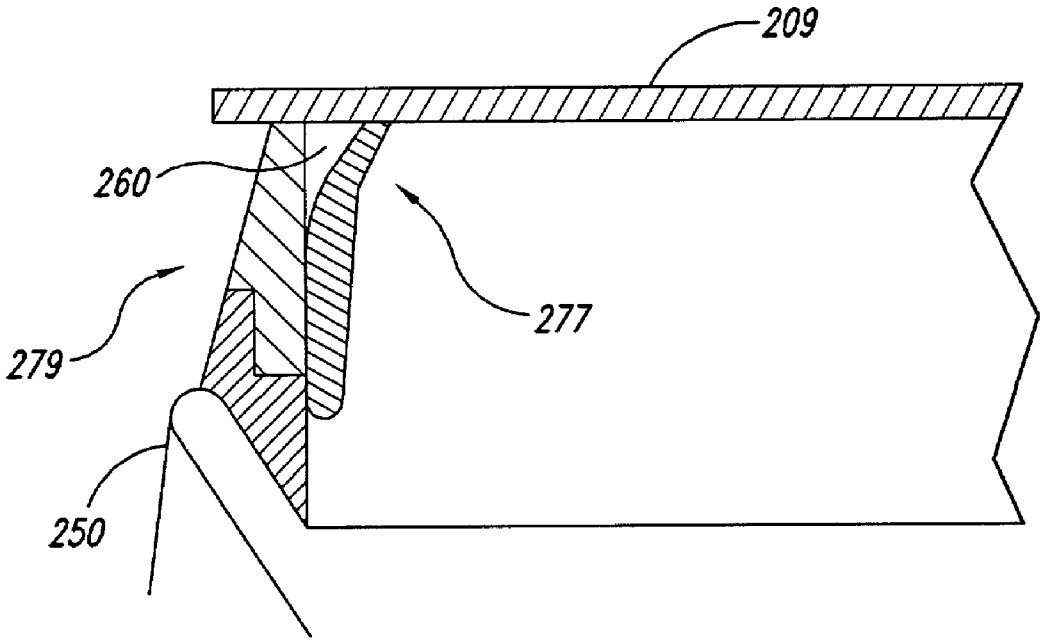
FIG. 9 is an enlarged fragmentary schematical view of a further alternate embodiment ring contact of the present invention.

FIG. 9 illustrates an alternate ring contact assembly 279. A compliant overmolded seal lip 277 extends from the outer plating cup ring portion 250 upwardly to the wafer 209. When the wafer is moved downwardly to engage the upper edge 279*a* of the ring contact assembly 279, the seal lip 277 may substantially seal the ring contact 260 from exposure to the plating fluid. The seal lip 277 ideally contacts on a photoresist layer of the workpiece, while the ring contact 260 contacts the plating seed layer.

Figure 10:
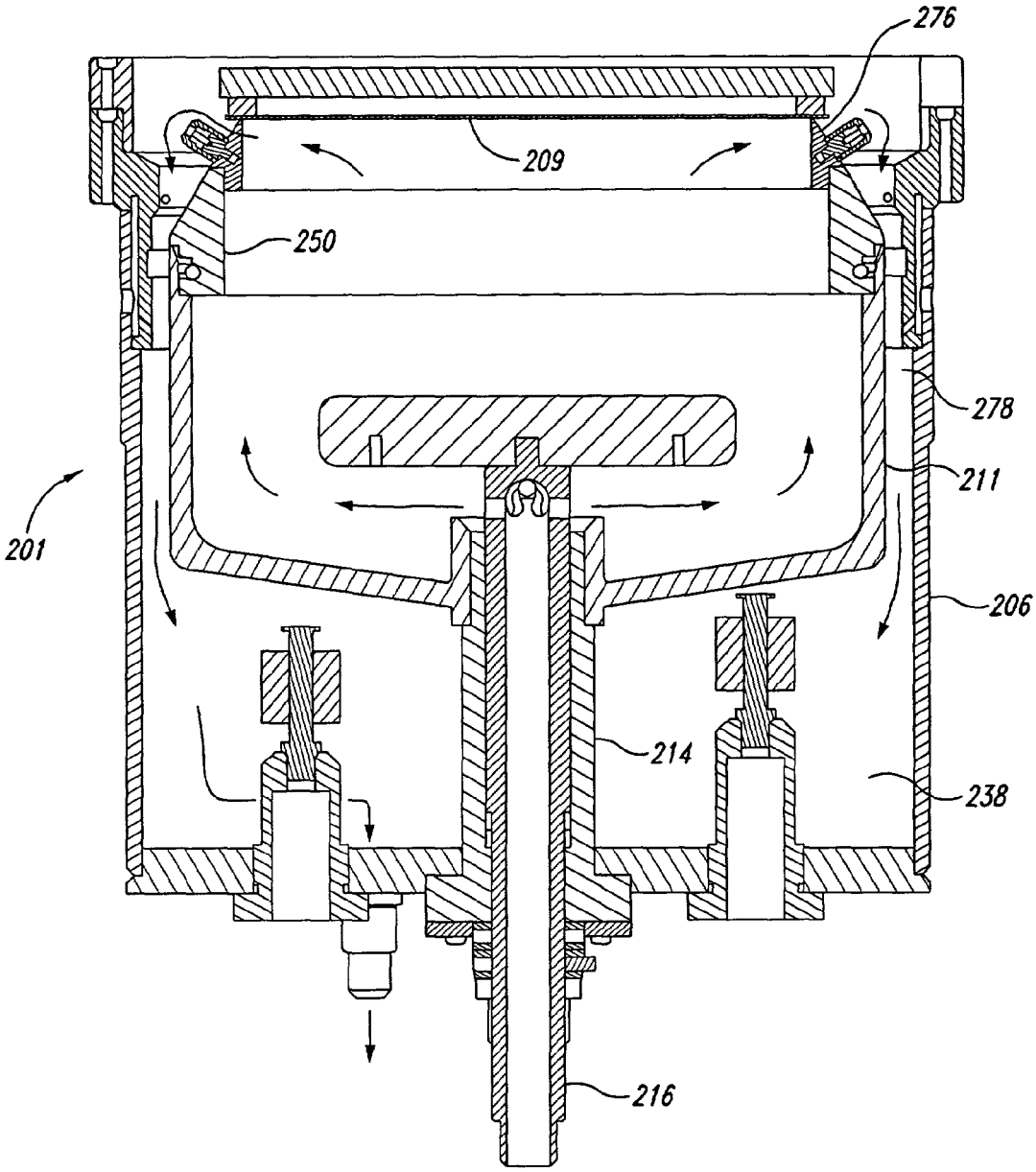
FIG. 10 is a simplified sectional view of an alternate embodiment reactor vessel according to the invention.

FIG. 10 illustrates a reactor vessel 201 in accordance with an alternative embodiment of the invention. The reactor vessel 201 may share many components in common with the reactor vessel 200 of FIG. 2 and like reference numbers are used in both drawings to refer to like components. One difference between the reactor vessels 200 and 201 is that the inner cup 226 and the outer cup 210 of the reactor vessel 200 are eliminated and replaced in the reactor vessel 201 by a single cup 211. The electroplating fluid flows upwardly from the conductor 216, and over the workpiece 209. The process electroplating fluid flows through the serrations of the alternate ring contact 276 (shown in FIG. 8) to an annular area 278 between the single cup 211 and the vessel side wall 206. The single cup 211 is supported on the support post 214. The single cup 211 does not include the apertures 236 associated with the outer cup 210 shown in FIGS. 2 and 3. The fluid that is collected in the reservoir 238 passes out of the outlet 240 and is recycled or disposed as per the previously described embodiment.

One advantage of the flow-through configuration of FIGS. 8 and 10, wherein the ring contact 276 serves as an overflow weir, is that the ring contact 276 may be immersed with overflowing plating solution when the wafer is not present. This condition allows the contact 276 to be plated and/or de-plated between wafers without decreasing throughput, i.e., automation for wafer cycling, moving wafers into and out of the vessel, can happen simultaneously with contact conditioning.

Figure 11:
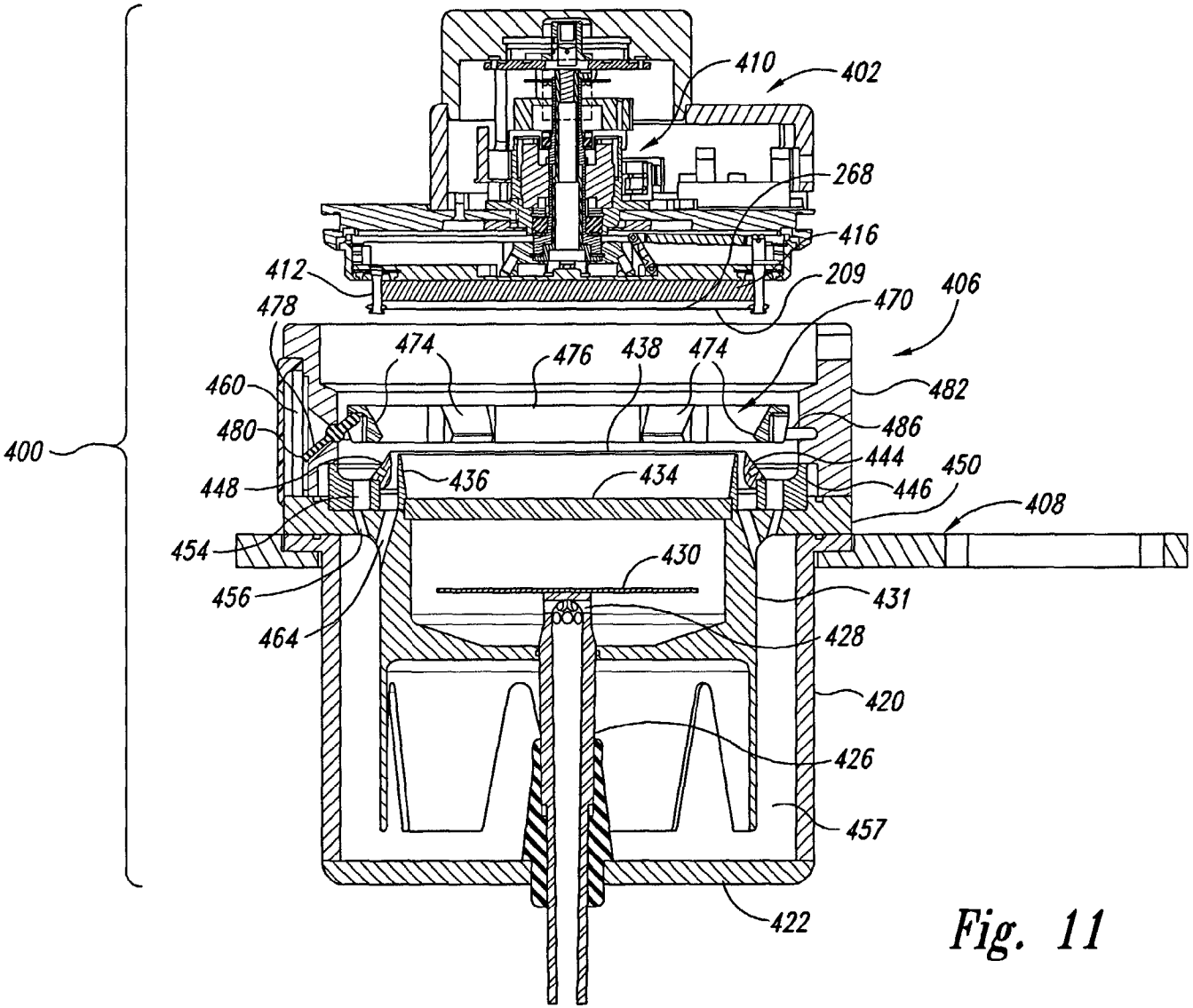
FIG. 11 is a sectional view of a further embodiment reactor vessel and head in a first relative position.

FIG. 11 illustrates a reactor head and vessel assembly 400 including a reactor head 402 and a reactor vessel 406 supported on a frame or deck 408. The reactor head 402 includes a mechanism 410 for activating workpiece gripping fingers 412 to grip or release a workpiece 209. An exemplary embodiment of a mechanism for gripping and releasing a workpiece with gripping fingers, and pivoting the fingers to release the workpiece, is disclosed in U.S. Pat. No. 5,377,708, issued Jan. 3, 1995, and herein incorporated by reference.

A top side backing plate 416 may be arranged to press, and sealingly isolate, the top side 268 of the workpiece as described for example with respect to the previously described embodiment of FIG. 2. In this view, the backing ring 264 is either not shown for simplicity of depiction, or is not needed based on the resilient characteristics of the materials chosen for the backing plate 416.

The vessel 406 includes an outer vessel side wall 420 sealed to a base 422. A fluid conduit conductor 426 delivers fluid into the vessel 406 through openings 428, and conducts electricity to an electrode 430. in this embodiment, a consumable anode is not used, i.e., the electroplating metal is introduced via the electroplating fluid.

A cup 431 is arranged within the vessel 406 and surrounds the electrode 430. A diffusion plate 434 is carried by the cup 431 above the electrode 430. An upper cup portion 436 includes top weir edge 438.

Surrounding the upper cup portion is a ring contact assembly 444 which includes a support ring 446 and a ring contact 448. The ring contact assembly 444 may be carried by the vessel 406, e.g., by being mounted on a top flange 450 of the cup 431. The support ring 446 includes passageways 454, aligned with passages 456 through the top flange 450, to drain fluid from above the support ring to a reservoir 457, and to vent reservoir gases through slots (not shown) to an exhaust plenum 460 for collection and recycling. Passages 464 through the flange 450 allow fluid passing over the weir edge 438 to return to the reservoir 457.

Figure 14:
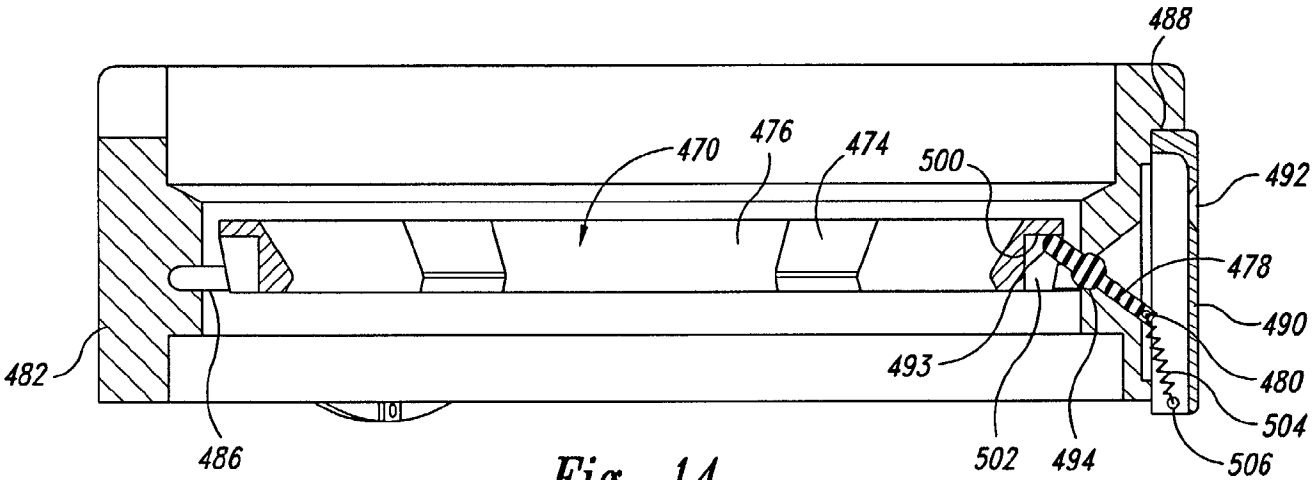
FIG. 14 is a sectional view of the support system shown in FIG. 13 shown in a first stage of operation.
Figure 15:
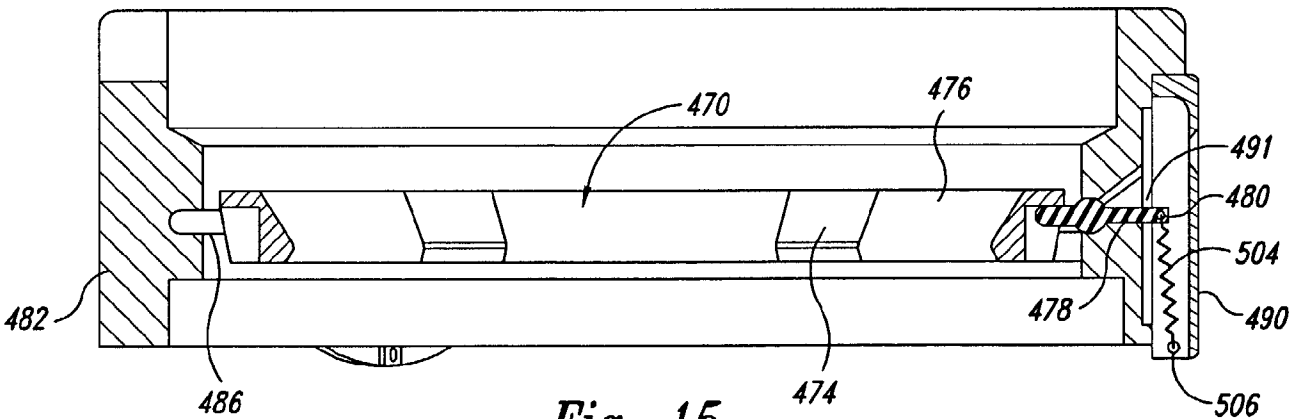
FIG. 15 is a sectional view of the support system of FIG. 14 shown in a second stage of operation.

A movable intermediate support assembly 470 for supporting a workpiece is located above the ring contact assembly 444. The support assembly 470 is operative to receive a workpiece 209 from the fingers 412 and to deliver the workpiece downwardly to a position resting on the ring contact 448. The support assembly 470 includes workpiece positioning supports 474 spaced around a workpiece positioning ring 476. The ring 476 is raised and lowered, e.g., by pivoting levers 478, and is guided for precise positioning of workpieces onto the ring contact 448. Each pivoting lever 478 has a base end 480 which may be spring-loaded, as shown in FIGS. 14 and 15.

Figure 12:
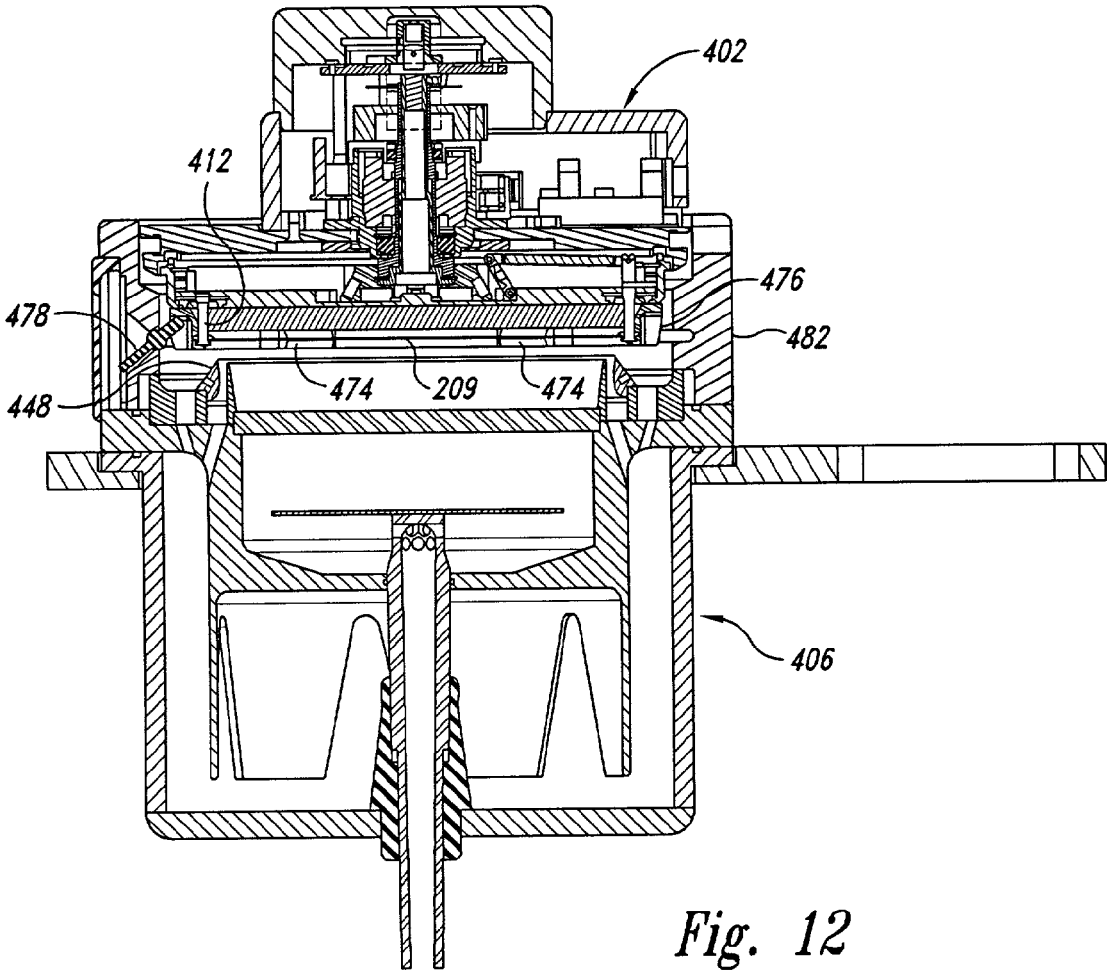
FIG. 12 is a sectional view of the reactor vessel and head of FIG. 11 in a second relative position.

FIG. 12 illustrates the reactor head 402 coupled to the vessel 406. The intermediate support assembly 470 is still in a raised position. The fingers 412 have lowered the workpiece 209 onto the supports 474. Pivoting the lever 478 of FIG. 12 in a clockwise direction will lower the support assembly 470 to a position where the workpiece is supported by the ring contact 448, the supports 474 dropping to a retracted position below the workpiece 209.

The support assembly 470 is centered and guided within an upper vessel ring 482. Each of the levers 478 is guided for pivoting by a guide formation of the upper vessel ring 482. Preferably, three levers 478 are provided and are spaced at 120° separation around the ring. Additionally, a plurality of guide rods 486 may be fixed to the vessel ring 487 and guided in slots (not shown) of the positioning ring 476 to set the horizontal positioning of the ring 476.

Figure 13:
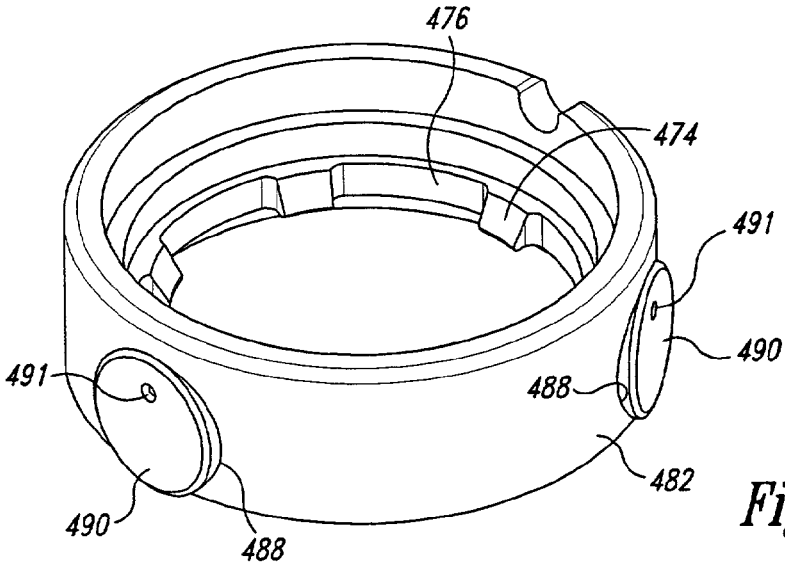
FIG. 13 is a perspective view of a movable intermediate support system employed in the apparatus of FIG. 12.

As illustrated in FIG. 13, the upper vessel ring 482 includes circular openings 488, one at each lever 478. A cover 490 is mounted into each opening 488 and held to the vessel ring 482 by one or more screws, recessed within one or more screw holes 491.

As illustrated in FIGS. 14 and 15, each lever 478 pivots about a trunnion 494. An opposite rounded end 493 of each lever presses against a top 500 of a guide slot 502 formed in the positioning ring 476. The base end 480 of the lever is connected by a spring 504 to a connection 506 on a respective cover 490.

FIG. 15 shows the support assembly 470 in the lowered position. Each lever 478 has pivoted about its respective trunnion 494 against the urging of a respective spring 504.

The head (402 in FIGS. 11 and 12) may force the support assembly 470 downwardly to overcome the upward biasing force of the springs 504 on their levers 478.

Figure 16:
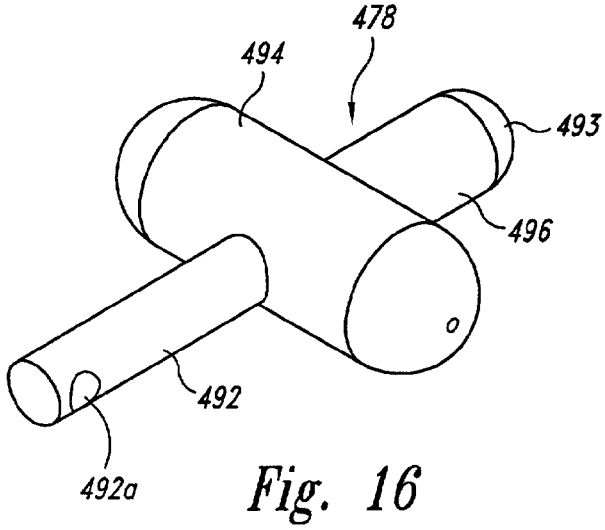
FIG. 16 is a perspective view of an operating lever of the intermediate support system of FIGS. 13–15.

FIG. 16 illustrates an embodiment of the lever 478 having an activation shaft 492, a trunnion 494, and an effecter arm 496 which carries the rounded end 493. The effecter arm 496 lifts or lowers the ring 476. The activation shaft includes a hole 492*a* for receiving an end of one spring 504.

Figure 17:
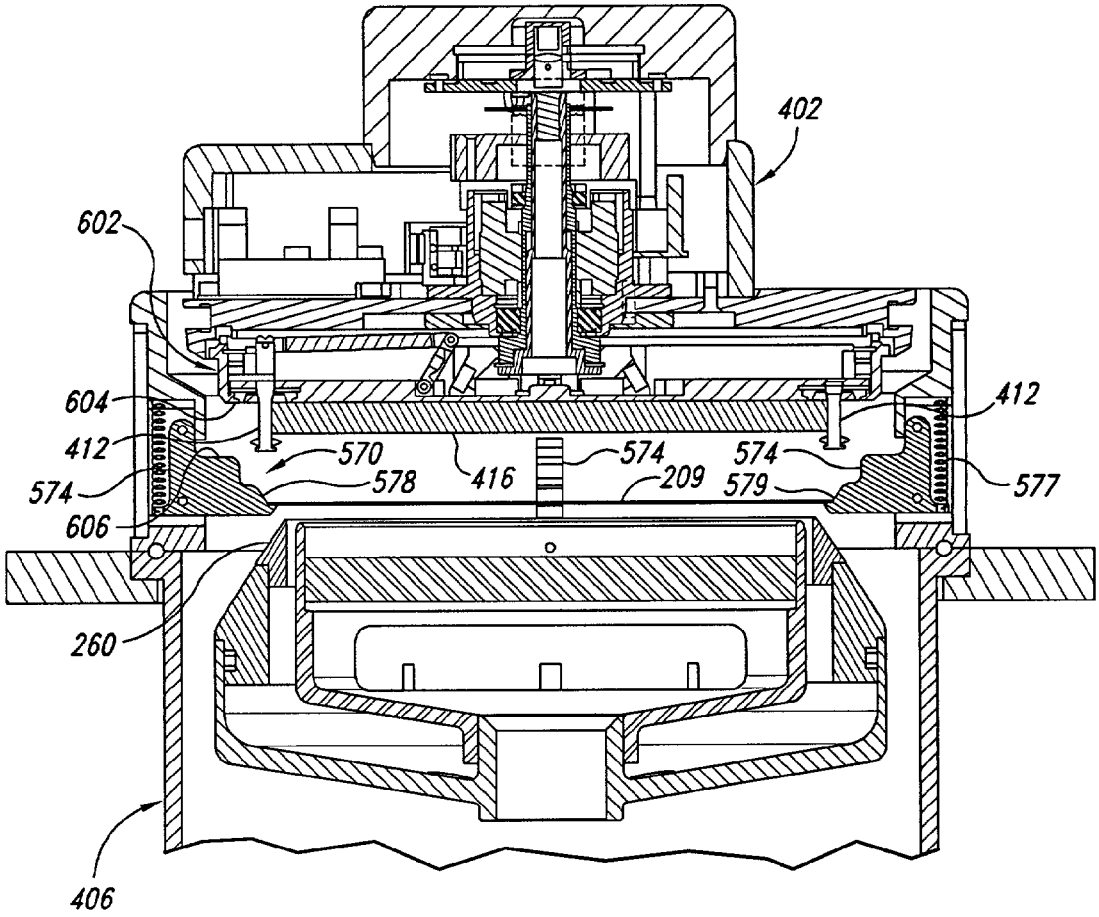
FIG. 17 is a simplified perspective, sectional view of a still further alternate embodiment of a reactor vessel of the invention.
Figure 18:
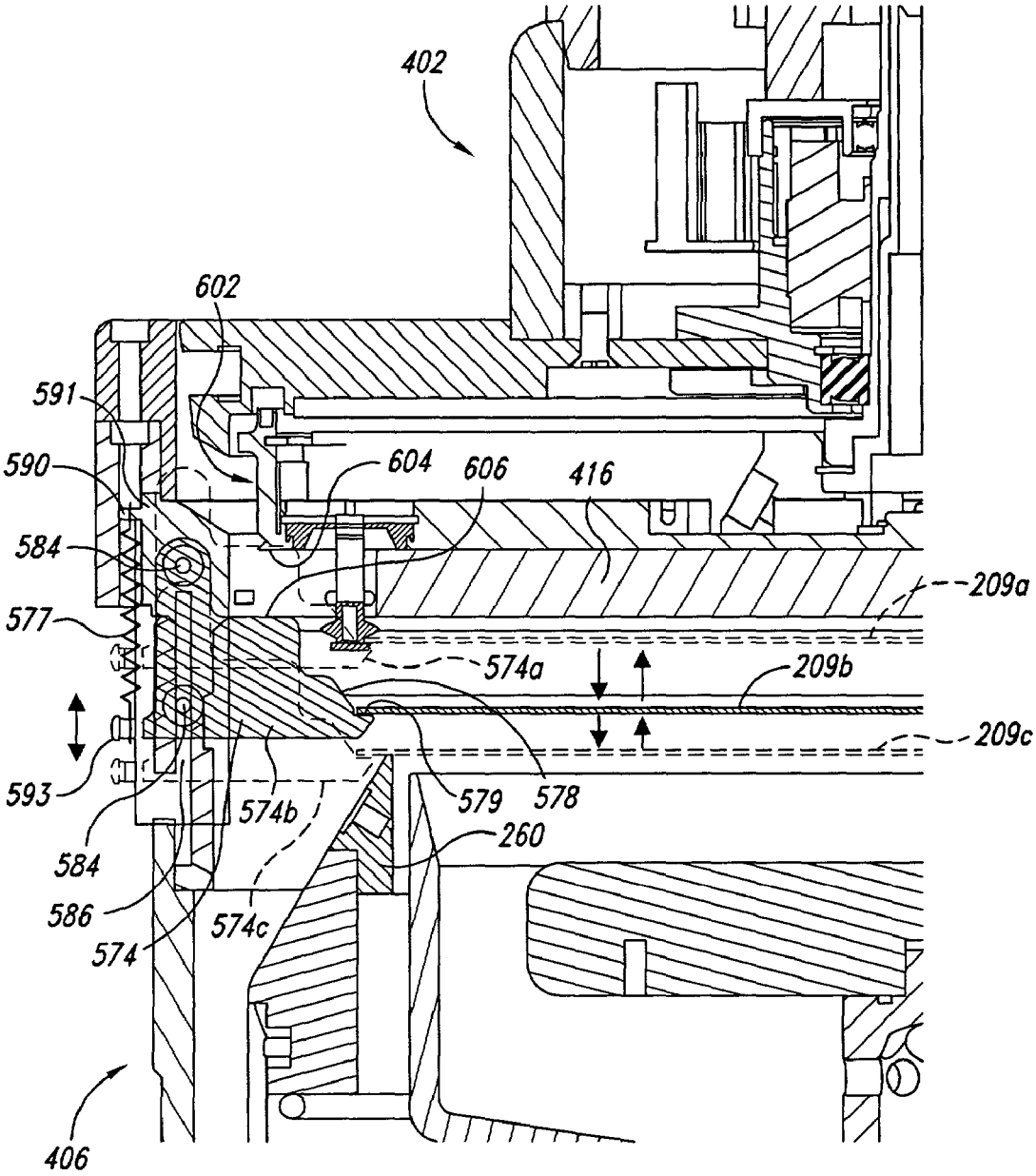
FIG. 18 is an enlarged, simplified fragmentary sectional view of the reactor vessel of FIG. 17.

FIGS. 17 and 18 illustrate an alternate movable intermediate support assembly 570. The assembly includes a plurality of workpiece supports 574. The supports 574 are actuated to be translated or slid downwardly, and are returned upwardly by spring tension from respective springs 577, each spring acting between an elevated fixture 590 on the vessel ring 591 and a lug 593 on the support 574. There are preferably three supports 574 spaced at 120° around a circumference of the vessel. Each support includes an inclined surface 578 for centering the workpiece between the supports 574. In operation, the workpiece fingers 412 deliver a workpiece to the assembly 570 and then tilt outwardly to release the workpiece onto the surfaces 578 to be guided to a ledge 579 of the supports. The location of the fingers 412 and the supports 574 are staggered circumferentially of the workpiece 209 to avoid interference.

As illustrated in FIG. 18, the supports 574 can be retracted upwardly to a position 574*a* to receive the workpiece 209 from the fingers 412 without any significant vertical drop of the workpiece. The supports are then lowered through the position marked 574*b* to the position marked 574*c* wherein the workpiece 209 rests on the ring contact 260 in position 209*c* and the supports are spaced below the edge of the workpiece. The workpiece moves through the positions marked 209*a*, 209*b*, 209*c*. To translate the supports, the lugs 593 can be lowered against spring tension of the springs 577 by an external actuator (not shown).

Alternatively, a finger plate 602 which carries the fingers 412 has a push surface 604 which can be lowered to press a contact surface 606 of the supports 574 downwardly against the urging of the springs 577 to deliver the workpiece 209 onto the ring contact 260.

As a further alternative, the head 402 can include a mechanism (not shown) attached thereto which depresses the supports 574 downwardly, and later releases the supports for upward movement, conjointly with the lowering and raising of the head 402 to the reactor vessel 406. The supports 574 are moved downwardly to deliver the workpiece 209 onto the ring contact 260.

As shown in FIG. 18, the supports 574 include two pins 584 which can vertically pass through a slot 586 formed into structure of the vessel such as in the vessel ring 591. The slot 586 guides the vertical movement of the support 574 to place and then later remove a workpiece 209 onto/from the ring contact 260.

Additionally, it is also readily derived from this invention disclosure that the supports 574 could be reconfigured to sweep outwardly about a pivot point which is rotationally fixed to the vessel, such as a pin placed substantially at the elevation shown for the pin 584 in FIG. 18. The clockwise rotation of the support 574, for example, would lower a workpiece onto a contact ring.

FIGS. 19A through 19D illustrate a further alternative embodiment for delivering a workpiece to a ring contact. Supports 774 can be guided for translation to lower the workpiece from the gripping fingers 412 to the ring contact 260 and then guided to rotate outwardly at an end of downward translation, to clear or move away from the workpiece 209. To provide for this movement, each support 774 has a guide plate 777 with top and bottom pins 780, 782 respectively. The pins are guided by a guide bracket 784 outside of the vessel 406. The guide bracket 784 includes a cam slot 786 having a vertical portion 788 and an oblique portion 790 extending from the vertical portion 788. The oblique portion 790 extends downwardly and radially outwardly relative to a centerline of the vessel 406. Thus, the support 774 will travel vertically while the pins 780, 782 are both within the vertical portion 788, but will rotate about the top pin 780 when the bottom pin 782 moves radially outwardly within the oblique portion 790 of the cam slot 786.

Figure 19A:
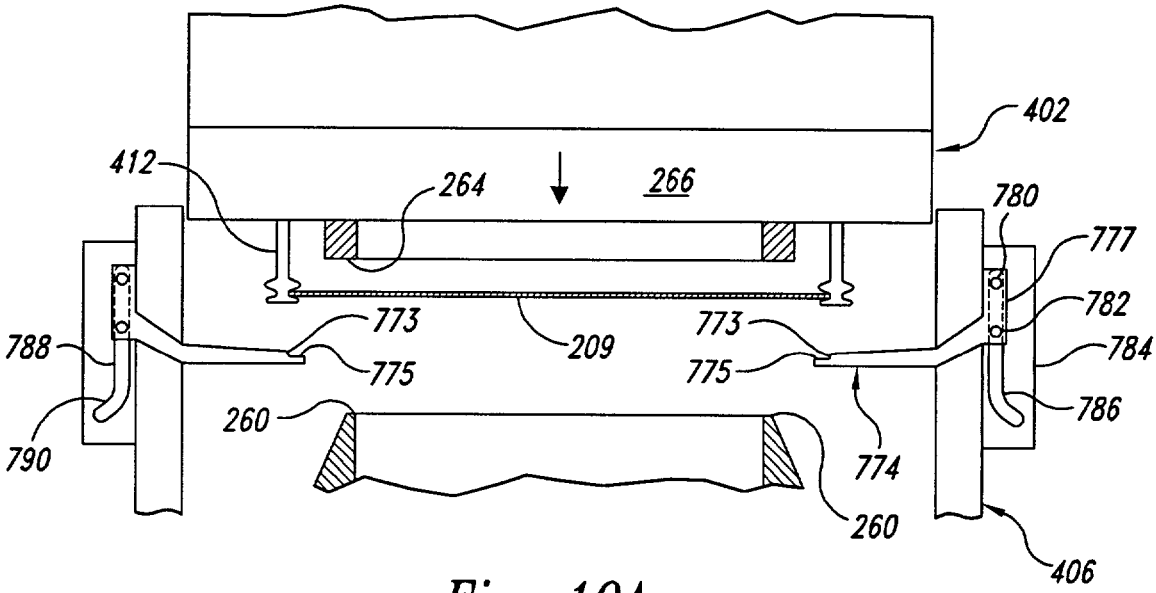
FIGS. 19A through 19D are schematic sectional views of an additional alternate embodiment intermediate support structure, shown in four progressive stages of operation.

In FIG. 19A, the head 402 is illustrated at an elevated position above the ring contact 260. The workpiece 209 is held by the fingers 412 above the supports 774 which extend from outside the vessel into the vessel. Each support 774 includes a workpiece supporting surface 775 adjacent to an inclined workpiece guiding surface 773. The guiding surfaces 773 will locate the workpiece at a correct position within a horizontal plane. The head may also include a backing plate 416 such as shown in FIG. 11 or a backing plate 266 with a resilient backing ring 264 as shown in FIG. 2.

Figure 19B:
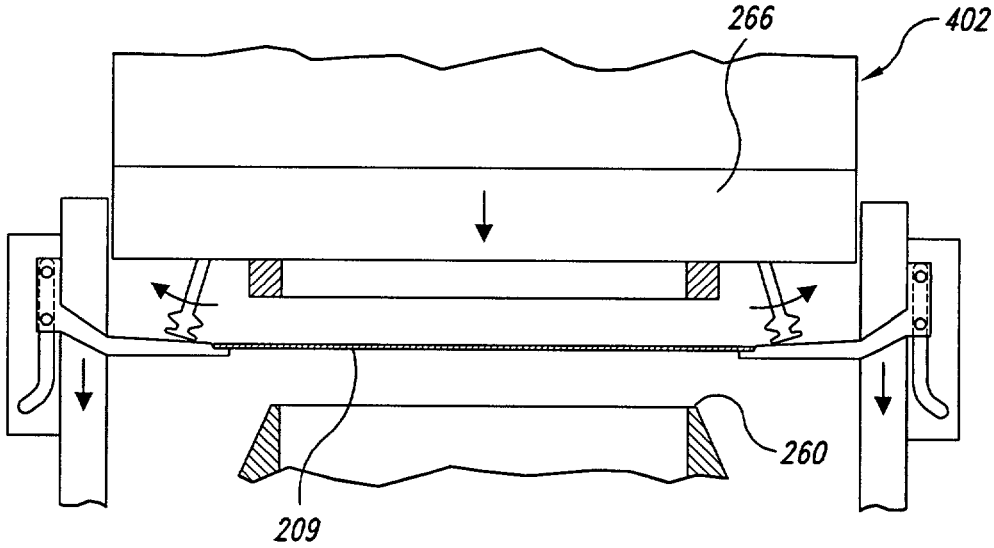

In FIG. 19B the head 402 has been lowered to deliver the workpiece 209 onto the support surfaces 775 of the supports 774. At this point in time and location within the vessel, the fingers 412 will rotate outwardly to clear the workpiece 209. At this point the workpiece is supported entirely on the support surfaces 775. Further downward movement of the head then moves the supports 774 downwardly (by a mechanism not shown) with the pins 780, 782 moving down the vertical portion 788 of each of the cam slots 786.

Figure 19C:
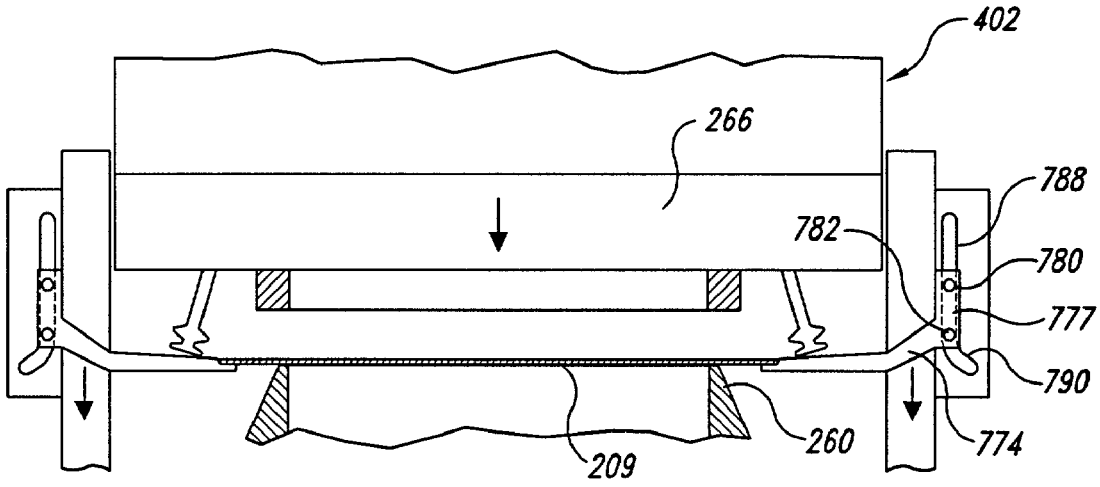

FIG. 19C illustrates that the supports have completed a purely vertical travel, and the workpiece rests on the ring contact 260.

Figure 19D:
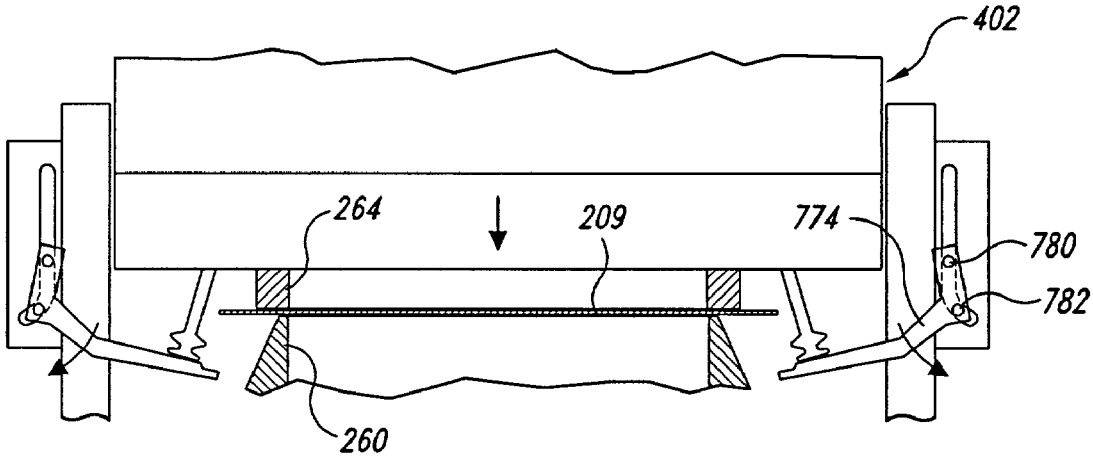

As illustrated in FIG. 19D, further vertical movement of the guide plates 777, particularly movement of the bottom pin 782 within the oblique slot portion 790, causes the support 774 to vertically descend and also to pivot about the top pin 780. This movement rotates the workpiece supporting surfaces 775 away from the workpiece 209.

The reactor head 402 further descends to press the resilient backing ring 264 against a top side of the workpiece as described above with respect to the embodiment of FIG. 2.

When the processing of the workpiece 209 is completed, the steps of FIGS. 19A–19D are reversed. The backing ring 264 is raised from the workpiece 209. The support 774 are lifted and rotated inwardly to pick up the workpiece. The workpiece is elevated within the vessel by vertical lifting of the supports 774. The fingers 412 are tilted inwardly to engage edges of the workpiece. The fingers 412 and the head 402 are lifted from the reactor vessel 406. The workpiece can then be removed and a new workpiece engaged by the fingers.

The ring contact of the present invention provides widely distributed electrical contact with the workpiece. This enhances electroplating uniformity and contact reliability. The assembly may provide back side protection of the workpiece. The contact can be constantly wetted to ensure contact quality. The contact construction can be more robust than prior known contact fingers.

Utilizing a fixed, i.e., non rotating, ring contact in accordance with embodiments of the invention increases reliability of plating power fed to the contact. Select embodiments automate workpiece delivery to the ring contact, utilizing the movable intermediate support system, which facilitates accurate contact placement relative to the workpiece exclusion zone. Non-rotation of the contact and the use of an intermediate support assembly can simplify the reactor head design by eliminating the motor necessary to rotate the workpiece and providing electroplating power connections in the vessel itself rather than in the vessel and the reactor head.

Numerous modifications may be made to the foregoing system without departing from the basic teachings thereof. Although the present invention has been described in substantial detail with reference to one or more specific embodiments, those of skill in the art will recognize that changes may be made thereto without departing from the scope and spirit of the invention as set forth in the appended claims.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

The invention claimed is:

1. A reactor for electroplating a workpiece, comprising:

a vessel;

a ring contact within and carried by said vessel, the ring contact being arranged to support a workpiece in a substantially horizontal orientation;

an electrode arranged below said ring contact;

a pressing member arranged above said ring contact to press a workpiece onto said ring contact;

said vessel configured to contain an electroplating fluid between a top of said ring contact and said electrode;

an intermediate support assembly carried by said vessel and having workpiece supports, said assembly being actuatable to lower a workpiece carried thereby to said ring contact; and a reactor head, said reactor head coupled to said vessel to form a substantially enclosed chamber for electroplating a workpiece, said reactor head configured to uncouple from said reactor vessel in order to receive a workpiece, said reactor head having a workpiece gripping mechanism to receive and grip a workpiece and adapted to release the workpiece onto said intermediate support assembly.

2. The reactor according to claim 1, wherein said ring contact has a serrated top edge that allows fluid to pass between said ring contact and a workpiece supported thereon.

3. The reactor according to claim 1, wherein said intermediate support assembly comprises a ring portion having spaced-apart, radially inwardly-directed workpiece supports, said ring portion actuatable to translate vertically within said vessel.

4. The reactor according to claim 3, wherein said intermediate support assembly includes at least one pivot lever and a spring, said pivot lever having a lift end engaged to said ring portion and an opposite end portion connected by said spring to said vessel.

5. The reactor according to claim 4, comprising a removable cover connected to said vessel which closes said pivot lever inside said vessel, said spring connected to said cover.

6. The reactor according to claim 1, wherein said ring contact includes a plurality of contact terminals having plug portions pressed into sockets formed into a surface of said ring contact, and said terminals having terminal sockets for receiving an end of a conductor, and a sleeve covering said contact terminal externally of said ring contact, said sleeve sealed to said surface of said ring contact around said socket.

7. A reactor for electroplating a workpiece, comprising:

a vessel having an electrical contact arranged to support a workpiece in a substantially horizontal orientation wherein said electrical contact is a ring contact with a serrated top edge that allows fluid to pass between said ring contact and a workpiece supported thereon;

an electrode arranged below said electrical contact;

an intermediate support assembly carried by said vessel and having workpiece support surfaces for supporting a workpiece, said assembly being actuatable to lower a workpiece carried thereby to be supported on said electrical contact; and said vessel adapted to contain an electroplating fluid between a top of said electrical contact and said electrode.

8. The reactor according to claim 7, comprising a reactor head, said reactor head coupled to said vessel to form a substantially enclosed chamber for electroplating a workpiece, said reactor head adapted to uncouple from said vessel in order to receive a workpiece, said reactor head having a workpiece gripping mechanism to receive and grip a workpiece and adapted to release the workpiece onto said intermediate support assembly.

9. The reactor according to claim 7, wherein said intermediate support assembly comprises a ring portion having spaced-apart, radially inwardly directed workpiece support members which provide said workpiece support surfaces, said ring portion actuatable to translate vertically within said vessel.

10. The reactor according to claim 9, wherein said intermediate support assembly includes at least one pivot lever and a spring, said pivot lever having a lift end engaged to said ring portion and an opposite end portion connected by said spring to said vessel.

11. The reactor according to claim 10, comprising a removable cover connected to said vessel which closes said pivot lever inside said vessel, said spring connected to said cover.

12. The reactor according to claim 7, wherein said workpiece support surfaces are movable to pivot outwardly to deliver said workpiece to said electrical contact.

13. The reactor according to claim 7, wherein said workpiece support surfaces are movable to pivot outwardly when said workpiece is delivered to said electrical contact to clear away from said workpiece.

14. The reactor according to claim 7, wherein said workpiece support surfaces are movable to translate vertically to lower said workpiece to said electrical contact.

15. The reactor according to claim 7, wherein said electrical contact comprises a ring contact and a plurality of contact terminals having plug portions pressed into sockets formed into a surface of said ring contact, and said terminals having terminal sockets for receiving an end of a conductor, and a sleeve covering said contact terminal externally of said ring contact, said sleeve sealed to said surface of said ring contact around said socket.

16. The reactor according to claim 7, wherein said electrical contact comprises a ring contact, and said reactor further comprising a ring contact seal lip extending upwardly from said ring contact to a bottom surface of said workpiece to seal thereto around a perimeter, said perimeter inside said ring contact.

17. A reactor for electroplating a workpiece, comprising:

a vessel adapted to contain an electroplating fluid;

an electrode arranged for fluid communication with electroplating fluid within the vessel;

a ring contact carried by the vessel, the ring contact being arranged to electrically contact a workpiece and horizontally support the workpiece at a location for contact with the electroplating fluid;

a reactor head arranged to carry a workpiece, the reactor head being moveable with respect to the vessel between a first position proximate the vessel and a second position spaced from the vessel to load and unload workpieces on the reactor head; and an intermediate support assembly carried by said vessel and having workpiece supports, said assembly being actuatable to lower a workpiece carried thereby to said ring contact, wherein said intermediate support assembly comprises a ring portion having spaced-apart, radially inwardly-directed workpiece supports, said ring portion being actuatable to translate vertically within said vessel.

18. The reactor according to claim 17, wherein said ring contact has a serrated top edge for allowing fluid to pass between a workpiece supported thereon and said ring contact.

19. The reactor according to claim 17, wherein said intermediate support assembly includes at least one pivot lever and a spring, said pivot lever having a lift end engaged to said ring portion and an opposite end portion connected by said spring to said vessel.

20. The reactor according to claim 19, comprising a removable cover connected to said vessel which closes said pivot lever inside said vessel, said spring connected to said cover.

21. A reactor for electroplating a workpiece, comprising:

a vessel adapted to contain an electroplating fluid;

an electrode arranged for fluid communication with electroplating fluid within the vessel;

a ring contact carried by the vessel, the ring contact being arranged to electrically contact a workpiece and horizontally support the workpiece at a location for contact with the electroplating fluid, wherein said ring contact includes a plurality of contact terminals having plug portions pressed into sockets formed into a surface of said ring contact, and said terminals having terminal sockets for receiving an end of a conductor, and a sleeve covering said contact terminal externally of said ring contact, said sleeve sealed to said surface of said ring contact around said socket;

a reactor head arranged to carry a workpiece, the reactor head being moveable with respect to the vessel between a first position proximate the vessel and a second position spaced from the vessel to load and unload workpieces on the reactor head; and intermediate workpiece supports, said workpiece supports being externally actuatable to lower a workpiece carried thereby to said ring contact.

22. The reactor according to claim 21, wherein said intermediate workpiece supports are actuated to pivot outwardly to clear away from said workpiece.

23. The reactor according to claim 21, wherein said intermediate workpiece supports are actuatable to translate vertically to lower said workpiece to said ring contact.

* * * * *